United States Patent [19]

Azam et al.

[11] 4,163,901

[45] Aug. 7, 1979

[54] COMPACT IRRADIATION APPARATUS USING A LINEAR CHARGED-PARTICLE ACCELERATOR

[75] Inventors: Guy Azam; André Bensussan; Jean-Baptiste Gallet; Duc Tien Tran, all of Buc, France

[73] Assignee: CGR-MeV, Buc, France

[21] Appl. No.: 893,780

[22] Filed: Apr. 5, 1978

[30] Foreign Application Priority Data

Apr. 6, 1977 [FR] France ..... 77 10394

[51] Int. Cl.[2] ..... H05G 1/26; G21G 4/00

[52] U.S. Cl. ..... 250/401; 250/493; 315/5.42

[58] Field of Search ..... 250/493, 401; 313/55, 313/44; 315/5.42, 5.41

[56] References Cited

U.S. PATENT DOCUMENTS

| | | | |
|---|---|---|---|
| 2,450,763 | 10/1948 | McNall | 313/44 |
| 2,519,826 | 8/1950 | Derby | 313/44 |
| 2,543,082 | 2/1951 | Webster | 315/5.42 |

*Primary Examiner*—Harold A. Dixon

*Attorney, Agent, or Firm*—Oblon, Fisher, Spivak, McClelland & Maier

[57] ABSTRACT

An irradiation apparatus comprising a fluid-tight enclosure in which are located a linear electron accelerator, a magnetron supplying a high frequency signal, means for injecting this high frequency signal into the accelerating structure, means for supplying voltage to the magnetron and the accelerator. A magnetic deflecting system can be associated with the linear accelerator for deflecting the accelerated electrons towards a target emitting X-rays. Cooling systems are provided inside the enclosure 1, in particular for cooling the magnetron.

14 Claims, 6 Drawing Figures

COMPACT IRRADIATION APPARATUS USING A LINEAR CHARGED-PARTICLE ACCELERATOR

BACKGROUND OF THE INVENTION

By means of linear charged-particle accelerators, it is possible to obtain beams of accelerated electrons of a few MeV to a few tens of MeV, or beams of photons which may be used in medicine (radiotherapy) or in industry (for example for testing materials). However, the linear accelerators which supply beams of the type in question are of fairly large dimensions. Now, in certain applications:

examination of welds in pipelines of small diameter;

radiography of the welds of frames of ships' hulls;

surgery under irradiation beams;

analysis of activation of rocks or geological strata, for example, it is essential to have an irradiation apparatus of small diameter, particularly when the irradiation apparatus in question has to be introduced into a space of limited width.

The irradiation apparatus according to the present invention has very small transverse dimensions and can be avantageously used in such application.

SUMMARY OF THE INVENTION

It is an object of the invention to provide a fluid-tight enclosure in which are located the following elements:

a linear charged-particle accelerator capable of emitting an irradiation beam, this accelerator comprising an electron gun, a magnetic focussing system for the electron beam, an accelerating structure formed by an accelerating section and a complementary section having one or more resonant cavities;

a high frequency generator supplying a high frequency signal;

means for injecting this high frequency signal into said accelerating structure;

means for supplying high voltage to the high frequency generator and to the accelerator;

means enabling a predetermined vacuum to be maintained in the accelerator during its operation;

cooling system for cooling at least some of the elements, this cooling system which are included in the enclosure enabling the heat generated by these elements to be dissipated into the wall of the enclosure.

BRIEF DESCRIPTION OF THE DRAWINGS

For a better understanding of the invention and to show how the same may be carried into effect, reference will be made to the drawings, given solely by way of example which accompany the following description and wherein.

DETAILED DESCRIPTION

Figure 1:
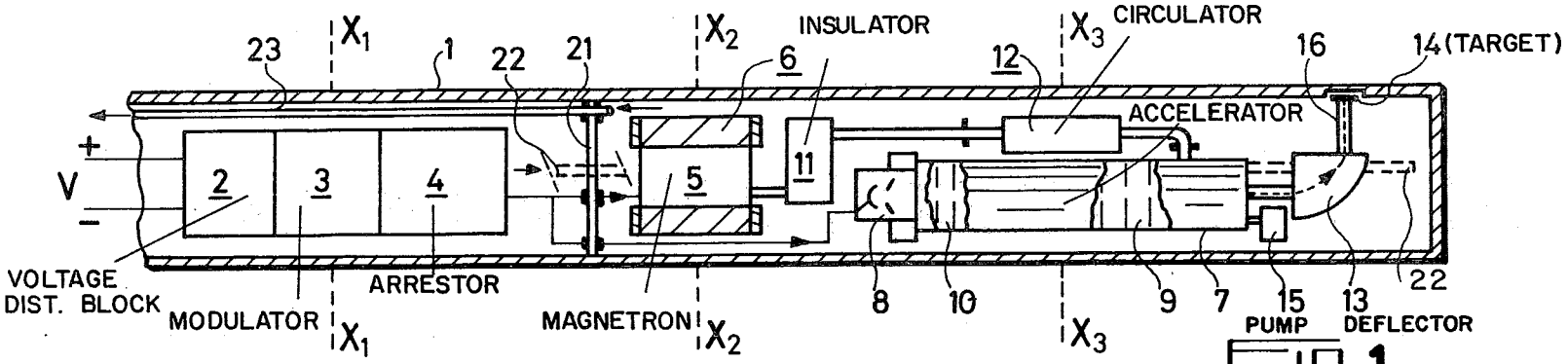
FIG. 1 diagrammatically illustrates an irradiation apparatus according to the invention.

In one example of embodiment, the irradiation apparatus according to the invention shown in FIG. 1 comprises a cylindrical metallic enclosure 1, for example of stainless steel, having a diameter D of approximately 10 to 20 centimeters and a length of approximately 2 meters (these dimensions are given by way of non-limiting example). This enclosure 1 accommodates:

a voltage distribution block 2 enabling the incident energy (approximately 1 kW) introduced into the enclosure 1 to be converted into d.c. or a.c. voltages required for the operation of the irradiation apparatus according to the invention;

a modulator 3 of the delay-line type released by a thyratron or by an arrestor 4, the delay line used having impedances of continuously different values. This is because, if a modulator comprising a conventional fixed-impedance delay line were used, it would be necessary to place between this delay line and the high frequency generator which it feeds an impedance-matching pulse transformer of which the size is considerable and which has to be cooled;

a high frequency generator which is, for example, a magnetron 5 of which the beam is subjected to the magnetic field of a permanent magnet 6;

a linear particle accelerator 7 comprising an electron gun 8 of which the operating voltage is equal to the voltage applied to the magnetron (a few tens of kilovolts), an accelerating structure formed by an accelerating section 9 and a complementary section 10, so-called preaccelerating and/or bunching section, such as described for example in Applicants' U.S. patent application Ser. No. 891,057, filed Mar. 28, 1978, (in cases where the accelerating section is a stationary wave section) or in Applicants' U.S. application Ser. No.891,057, filed Mar. 28, 1978, (in cases where the accelerating section is a progressive wave section). The magnetron 5 supplies a high frequency signal which may be injected into the accelerating section 9 by means of a high frequency circuit comprising, for example, an insulator 11 where the accelerating section is of the progressive wave type or an insulator 11 and a circulator 12 where the accelerating section is of the stationary wave type (FIG. 1);

a magnetic deflection system 13 for the beam of accelerated particles enabling it either to issue laterally from the enclosure 1 through a window formed for that purpose or to impinge on a target 14 capable of emitting photons;

an independent vacuum pump 15 (for example a continuously activated getter).

Figure 2:
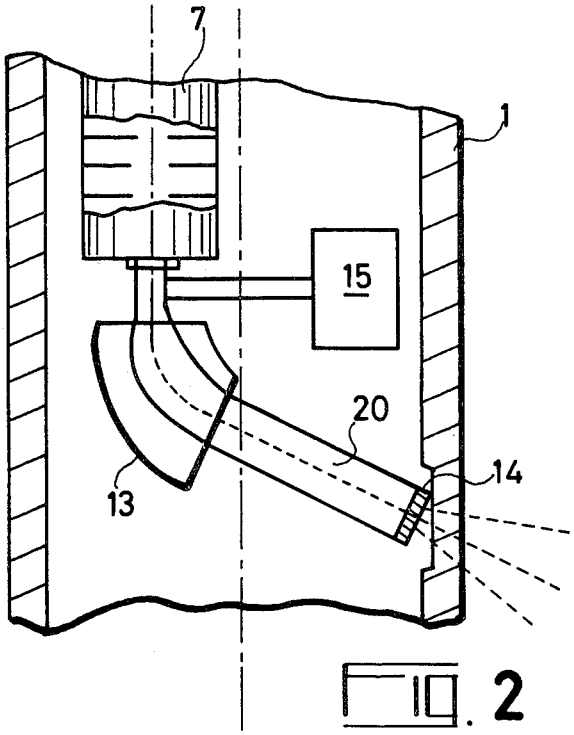
FIG. 2 shows details of an apparatus constructed in accordance with the invention.

In the operation of the example of embodiment shown in FIG. 1, the accelerated beam is deflected in such a way that it is able to impinge on the tungsten target 14 placed at the level of the lateral wall of the enclosure 1. FIG. 2 shows a detail of another example of embodiment. The tungsten target 14 seals off a vacuum chamber 20 into which the beam of charged particles (electron) is deflected. Under the impact of the electron beam, the target 14 emits a beam of photons of which the mean trajectory forms an angle $\alpha$ ($\alpha=\pi/2$ for example) with a generatrix of the enclosure 1. In another example of embodiment (not shown), the beam of electrons can arrive at the target in a direction parallel to the axis of the enclosure 1. It may also be previously deflected on either side of its mean trajectory by periodically magnetic deflection system.

Figure 3:
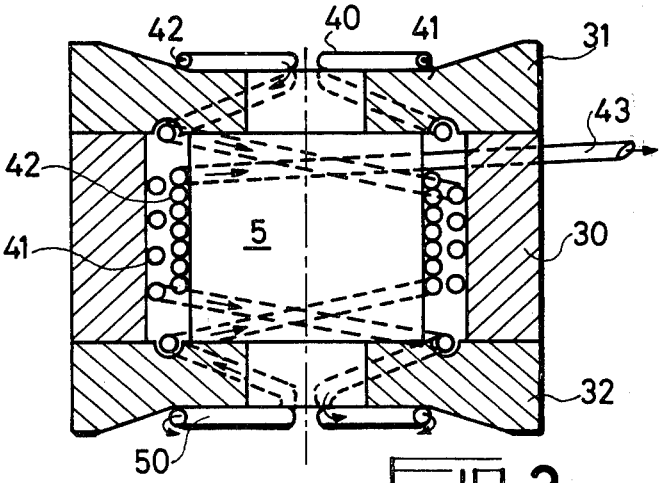
FIG. 3 shows a cooling circuit for a magnetron used as high frequency generator in their irradiation apparatus according to the invention.

In the example of embodiment of the irradiation apparatus according to the invention shown in FIG. 1, the high frequency generator is a magnetron 5 operating for example in the frequency band X (7000 to 12,000 MHz). This magnetron 5 is associated with a permanent magnet 30 and is provided with pole pieces 31 and 32 which have to be suitably cooled so as to retain the magnetic characteristics of the permanent magnet 30. An auxiliary cooling circuit may be provided for this purpose. In the example shown in FIG. 3, the cooling circuit, in which a fluid may circulate, comprises two tubular rings 40 and 50 in contact with the free surfaces of the pole pieces 31 and 32. These tubular rings 40 and 50 are connected by means of a first helical tube 41 placed in contact with the inner wall of the permanent magnet 30, for example cylindrical in shape. The second tubular ring 50 is also connected to a second helical tube 42 which is coaxial with the magnetron 5 and which is applied against the outer wall of the magnetron 5. In operation, the cooling fluid injected into the ring 40 flows successively through the ring 40, the helical tube 41, the second ring 50 and then the second helical tube 42 before leaving by the tube 43 and being delivered along the wall of the coldest part of the enclosure 1, the temperature gradient between the two ends of the cylindrical enclosure 1 being capable of assuming considerable proportions. A pump (not shown in FIG. 1) may be arranged in or out off the enclosure 1 for circulating the cooling fluid in the auxiliary cooling circuit.

Other means enabling above all the accelerator 7 and the magnetron 5 to be cooled may be provided, as shown in FIG. 1. A shut-off plate 21 positioned along a cross-section of the enclosure 1 serves to define a space into which another cooling fluid is introduced by means of an inlet tube 22 extending deeply into the enclosure 1 and is removed by means of an outlet tube 23 connected to a pump which enables this other cooling fluid to be delivered to a tubular coil placed in contact with the inner wall of the inclosure 1 at that end of the enclosure opposite the irradiation end. Cooling fins may be associated with that end which is opposite the irradiation end.

In the operation of the example of embodiment shown in FIG. 1, the voltage used for injecting the electrons into the accelerating structure is equal to the high voltage applied to the magnetron, i.e. 30 to 40 kV for example. Under these conditions, the velocity of the electrons is approximately 0.37 c (c being the speed of light). In this case, it is of particular advantage to use an accelerating structure of the type described in Applicants' U.S. patent application Ser. No. 891,057 or Ser. No. 891,058, both filed Mar. 28, 1978.

Finally, it is pointed out that the frequency of the high frequency generator (the magnetron 5 in FIG. 1) has to be subjugated to the operating frequency of the accelerator. To this end, the following solutions may be used:

either extracting a fraction of the high frequency energy reflected by the accelerating section and superimposing this signal upon the injected signal, in which case subjugation is obtained by means of the signal supplied by this superposition;

or comparing the phases of the signals injected and extracted in the accelerating section (Applicants' U.S. patent application Ser. No. 895,193);

or using two reference cavities tuned respectively to the frequencies $f_1$ and $f_2$ so that $(f_1+f_2)/2=f_o$, $f_o$ being the operating frequency of the accelerating section, as described by Applicants in their U.S. patent application, Ser. No. 768,370. After amplification, the error signal may act either on a motor acting on the frequency variation system of the magnetron or on any other known means capable of modifying the frequency of the magnetron.

Figure 5:
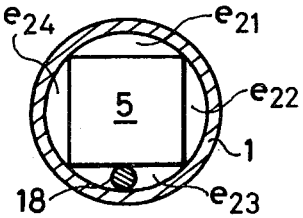
Figure 4:
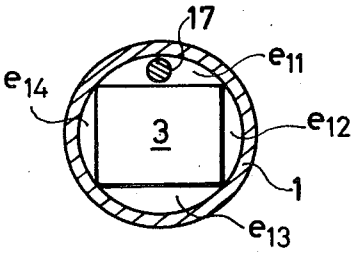

In the example of embodiment of the irradiation apparatus according to the invention shown in FIG. 1, certain elements (for example the modulator 4 and the magnetron 5) have external dimensions such that they come to rest on the inner wall of the enclosure 1, forming free spaces $e_{11}$, $e_{12}$, $e_{13}$, $e_{14}$ and $e_{21}$, $e_{22}$, $e_{23}$, $e_{24}$ for the passage of the various feed circuits 17, 18. . ., as shown by the cross-sections along $X_1X_1$, $X_2X_2$ of FIGS. 4 and 5.

Figure 6:
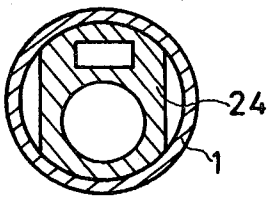
FIGS. 4 to 6 are respectively three cross-sections through the apparatus shown in FIG. 1.

Certain other elements, for example the accelerator 7 and the circulator 12, may be positioned in the enclosure 1 by means of supporting frames 24 (FIG. 6) made of a heat-conductive material (for example copper), these supporting frames resting on the inner wall of the enclosure 1 and being able to contribute to the effective cooling of these elements (particularly the accelerator 7).

The irradiation apparatus according to the invention may with advantage replace the $\gamma$-ray irradiations which necessitate heavy and cumbersome protection screens and of which the intensity of the irradiation beam varies as a function of time which necessitates successive re-evaluations of the exposure times.

What we claim is:

1. A compact irradiation apparatus comprising a fluid-tight enclosure in which are located at least the following elements:

a linear charged-particle accelerator capable of emitting an irradiation beam, this accelerator comprising an electron gun, a magnetic focussing system for the beam of electrons, an accelerating structure formed by an accelerating section and a complementary section with resonant cavities;

a high frequency generator supplying a high frequency signal;

means for injecting this high frequency signal into said accelerating structure;

means for supplying high voltage to the high frequency generator and to the accelerator;

means enabling a predetermined vacuum to be maintained in the accelerator during its operation;

a cooling system for cooling at least some of the elements is included in the enclosure, this cooling system enabling the heat generated by these elements to be dissipated into the wall of said enclosure, said high frequency generator being a magnetron associated with permanent magnets, the magnetron and its permanent magnets being cooled by an auxiliary cooling circuit disposed along their walls, this cooling circuit comprising a first tubular ring and a second tubular ring arranged on either side of the pole pieces of the magnetron and in contact therewith, these two rings being connected by a first helical tube placed against the inner walls of the permanent magnets, in that a second helical tube is placed against the outer wall of said magnetron, the two helical tubes being connected to one another by the second tubular ring in such a way that a cooling fluid is able to circulate in the second helical tube after having passed through the first tubular ring, the first helical tube and the second tubular ring.

2. An irradiation apparatus as claimed in claim 1, wherein said magnetic focussing system for focussing said particle beam along the accelerating structure is constituted by permanent magnets.

3. An irradiation apparatus as claimed in claim 1, wherein said system for magnetically deflecting the beam of accelerated electrons is arranged at the output end of the accelerator, said deflection system, formed by permanent magnets, enabling said beam to be deflected through an angle $\theta$ and directed towards an exit window formed in the lateral wall of the enclosure.

4. An irradiation apparatus as claimed in claim 3, wherein said angle $\theta$ is $\pi/2$.

5. An irradiation apparatus as claimed in claim 1, wherein said accelerator is provided at its output end with a tubular vacuum chamber which, at its free end, carries a target capable of delivering a beam of X-rays under the impact of said beam of accelerated electrons.

6. An irradiation apparatus as claimed in claim 5, wherein said tubular vacuum chamber is curved through an angle $\theta$.

7. An irradiation apparatus as claimed in claim 1, wherein said means for suppling high-voltage comprise a modulator of the "delay line" type, released by means of an arrestor, said delay line having continuously varied impedances.

8. An irradiation apparatus as claimed in claim 1, wherein said magnetron and said linear accelerator are fed with the same high voltage.

9. An irradiation apparatus as claimed in claim 1, wherein a voltage distributing block is disposed in said enclosure, said distributing block enabling the various elements disposed in said enclosure to be supplied with their suitable voltages.

10. An irradiation apparatus as claimed in claim 1, wherein said accelerator at least is positioned by means of supporting frames which rest on the inner lateral wall of the enclosure, said frames being made of a material of high thermal conductivity capable of acting as cooling means.

11. An irradiation apparatus as claimed in claim 10, wherein said supporting frames have external dimensions such that they can be accommodated in the circular cross-section of the enclosure, leaving free spaces for the passage of the various feed circuits.

12. An irradiation apparatus as claimed in claim 1, wherein the part of said enclosure which contains at least said accelerator and said magnetron is filled with a cooling fluid, said part of the enclosure being closed by a shut-off plate through which extend an inlet tube and an outlet tube for the fluid.

13. An irradiation apparatus as claimed in claim 12, wherein a pump associated with said enclosure circulates the cooling fluid issuing from said outlet tube in tubes placed in contact with the inner wall of the enclosure in that zone opposite the zone containing said accelerator in such a way as to be able to dissipate the heat given off by the elements into the wall of the said opposite zone.

14. An irradiation apparatus as claimed in claim 1, wherein said enclosure is provided with a double wall, means being provided outside the enclosure cause a cooling fluid to circulate between said double wall.

* * * * *